US008498787B2

(12) United States Patent
Keefer

(10) Patent No.: US 8,498,787 B2
(45) Date of Patent: Jul. 30, 2013

(54) METHOD AND SYSTEM FOR MONITORING THE OPERATION OF A CABLE SHOVEL MACHINE

(75) Inventor: Claude Wesley Keefer, Elmwood, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 287 days.

(21) Appl. No.: 13/117,626

(22) Filed: May 27, 2011

(65) Prior Publication Data

US 2012/0303224 A1 Nov. 29, 2012

(51) Int. Cl.
*E02F 3/46* (2006.01)
*G06F 19/00* (2011.01)

(52) U.S. Cl.
USPC ..... 701/50; 701/468; 414/685

(58) Field of Classification Search
None
See application file for complete search history.

(56) References Cited

U.S. PATENT DOCUMENTS 5,408,767 A * 4/1995 Hazama et al. ..... 37/396
5,850,341 A 12/1998 Fournier et al.
5,864,060 A 1/1999 Henderson et al.
6,191,733 B1 * 2/2001 Dizchavez ..... 342/357.57
6,225,574 B1 5/2001 Chang et al.
6,466,850 B1 10/2002 Hilgart
7,734,397 B2 6/2010 Peterson et al.
2007/0266601 A1 11/2007 Claxton

* cited by examiner

*Primary Examiner* — Michael J Zanelli
(74) *Attorney, Agent, or Firm* — Dinsmore & Shohl LLP

(57) ABSTRACT

A monitor system for an electric cable shovel determines when the shovel has completed a digging operation, and a subsequent dumping operation. The system includes an inclinometer, a current sensor, and a monitor circuit. The inclinometer is mounted on the dipper arm for providing an output indicative of the inclination of the dipper arm. The current sensor senses the level of the electrical current supplied to the electric motor. The monitor circuit determines when the current sensor provides an indication of a current level in excess of a digging current threshold level for a period of time in excess of a predetermined period, and during such period of time the inclinometer indicates that the inclination of the dipper arm is below a digging threshold inclination. In such a case, the monitor circuit provides an output indicating that the shovel has completed a digging operation. A subsequent dumping operation is monitored in a similar manner, with the rotation of the monitor and the actuation of the trip lever being sensed. GPS receivers on the electric cable shovel body provide an indication of the location at which the shovel is digging, and a worksite model is referenced to determine the material being mined.

14 Claims, 3 Drawing Sheets

METHOD AND SYSTEM FOR MONITORING THE OPERATION OF A CABLE SHOVEL MACHINE

CROSS-REFERENCE TO RELATED APPLICATIONS

None.

STATEMENT REGARDING FEDERALLY SPONSORED RESEARCH OR DEVELOPMENT

Not Applicable.

BACKGROUND

This relates to a monitor system for an electric cable shovel, and a method of operating a monitor system for an electric cable shovel. Electric cable shovels are large excavating machines that find wide use in material removal operations, such as for example in mining. The process of removing material from a mine worksite commonly aided by the use of a digital model of the topography of the worksite, including information defining locations of ore deposits within the worksite, as well as the different concentrations or grades of ore and the topology of the worksite. The site model may include property boundaries, not only of the mine itself, but also any internal boundaries which mark portions of the mine that may be separately owned. Using this information, a mine plan can be developed which defines the way in which the top soil and ore are removed from the worksite. In the past, it has been common for surveying and stake setting crews to mark the worksite with flags or stakes to reflect the site model. The site model and the location of the stakes must then be updated periodically to reflect the mining progress at the site.

To reduce the amount of labor required to set stakes and to simplify the operation of an electric cable shovel, several systems have been developed which keep track of the excavation process. One such system is disclosed in U.S. Pat. No. 5,864,060, issued Jan. 26, 1999, to Henderson et al. The Henderson system monitors the progress of an excavator at a worksite based primarily on the time that the machine is maintained in various positions. The system determines the angular velocity of the excavator as it rotates about a vertical axis from a position where digging is accomplished to a position in which the excavator is unloaded. The machine is stopped in response to the angular velocity being less than a specified amount, and this condition is detected. The length of time that the machine is stopped is measured. The work cycle of the machine is then determined, based on this measurement.

Another monitor system is shown in U.S. Pat. No. 5,850,341, issued Dec. 15, 1998 to Fournier et al. In the Fournier system, the operation shifting the transmission of an excavator between forward and reverse is detected. This is taken by the system as an indication of digging with the excavator. The Fournier system and other systems are not as direct and straightforward as might otherwise be desired. Further, it is desirable that the monitor system be able to determine the nature of the ore being mined and distinguish soil from the soil having a large ore content which may have little or no ore content.

SUMMARY

A monitor system for an electric cable shovel determines when the shovel has completed a digging operation. The electric cable shovel has a shovel body mounted for rotation on a base, a boom extending upward from the shovel body and connected at its lower end to the body, a pulley mounted on the upper end of the boom, a dipper bucket suspended from the boom by a dipper cable extending over the pulley, a winch mounted on the shovel body and secured to the dipper cable, the winch including a winch drum and an electric motor for winding and unwinding the dipper cable on the winch drum so as to raise and lower the dipper bucket, and a dipper arm secured to the dipper bucket and supported by an arm mechanism for moving the arm toward and away from the body of the shovel. The system includes an inclinometer, a current sensor, and a monitor circuit. The inclinometer is mounted on the dipper arm for providing an output indicative of the inclination of the dipper arm. The current sensor senses the level of the electrical current supplied to the winch electric motor. Finally, the monitor circuit determines when the current sensor provides an indication of a current level in excess of a predetermined digging current threshold level for a period of time in excess of a predetermined period, and during such period of time the inclinometer indicates that the inclination of the dipper arm is below a digging threshold inclination. In such a case, the monitor circuit provides an output indicating that the shovel has completed a digging operation, filling the dipper bucket with material.

The monitor system may also include a pair of GPS receivers, mounted on the shovel body, and a sensor in the arm mechanism for determining the extension of the arm with respect to the boom. The monitor circuit may be responsive to the GPS receivers and to the sensor in the arm mechanism, for determining the location and orientation of the electric cable shovel body, and for determining the location of the digging operation.

The monitor system may further include a rotation sensor for sensing rotation of the body of the electric cable shovel on the base of the shovel, and a dipper bucket trip lever sensor for sensing actuation of the trip lever by an operator. The monitor circuit may be responsive to the rotation sensor and the trip lever sensor for determining when a load of material in the dipper bucket has been dumped following rotation of the body through a minimum rotation angle. In such a case, the monitor circuit provides an output indicating that the shovel has completed a dumping operation.

The monitor system may further include a memory having stored therein a site model including data specifying the location and grade of ore at the worksite. The monitor system compares each digging operation to the site model to determine the ore in the material in the dipper bucket, so that the bucket may be dumped in an appropriate transport truck.

A method of monitoring the operation of an electric cable shovel includes the steps of determining the inclination of the dipper arm, sensing the level of the electrical current supplied to the electric motor, determining when the current level exceeds a digging current threshold level for a period of time in excess of a predetermined period, and during such period of time the dipper arm is below a digging threshold inclination, and providing an output indicating that the shovel has completed a digging operation. The monitor system may further include a pair of GPS receivers mounted on the shovel body, or a single GPS receiver and a heading sensor, and the method may further include the steps of determining the extension of the arm with respect to the boom, determining the location and orientation of the electric cable shovel body, and determining the location of the digging operation. The electric cable shovel may further include a rotation sensor for sensing rotation of the body of the electric cable shovel or it may use the GPS receivers and a heading sensor on the base of the shovel to determine rotation, and a dipper bucket trip lever sensor for sensing actuation of the trip lever by an operator. The method may further include the step of determining when a load of material in the dipper bucket has been dumped following rotation of the shovel body through a minimum rotation angle. The monitor system may further include a memory having stored therein a site model having data specifying the location, including elevation information, and grade of ore at the worksite. The method may further include the steps of comparing each detected dig operation to the site model to determine the ore in the material in the dipper bucket resulting from the dig operation so that the dipper bucket may be dumped in an appropriate transport truck.

DETAILED DESCRIPTION

Figure 1:
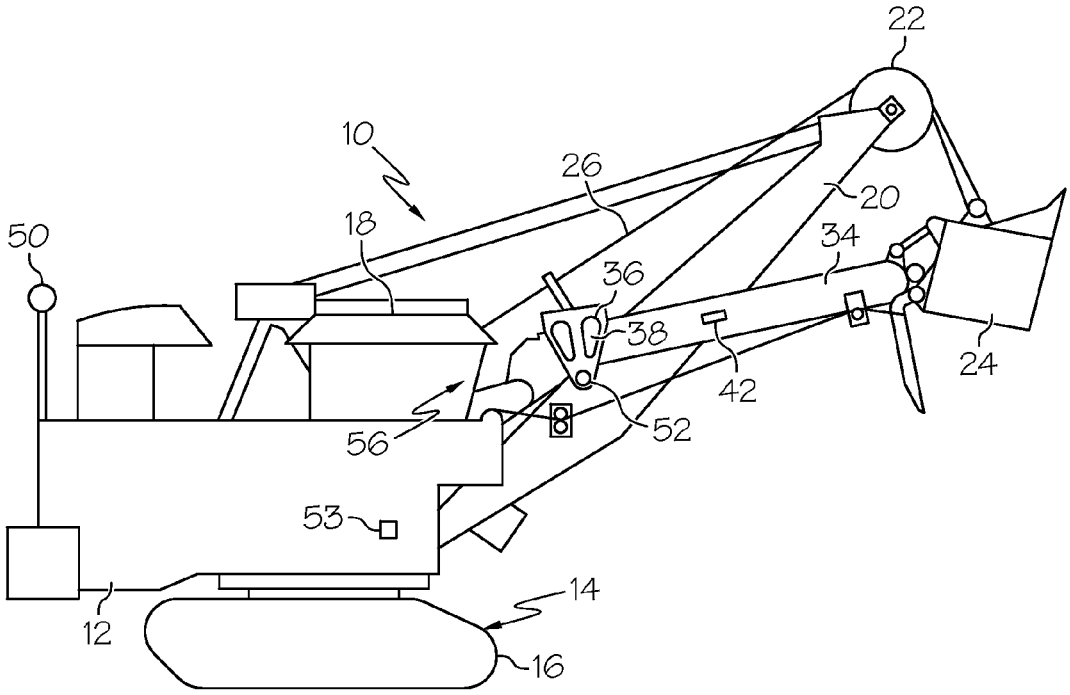
FIG. 1 is a side view of an electric cable shovel incorporating an embodiment of the monitor system.
Figure 2:
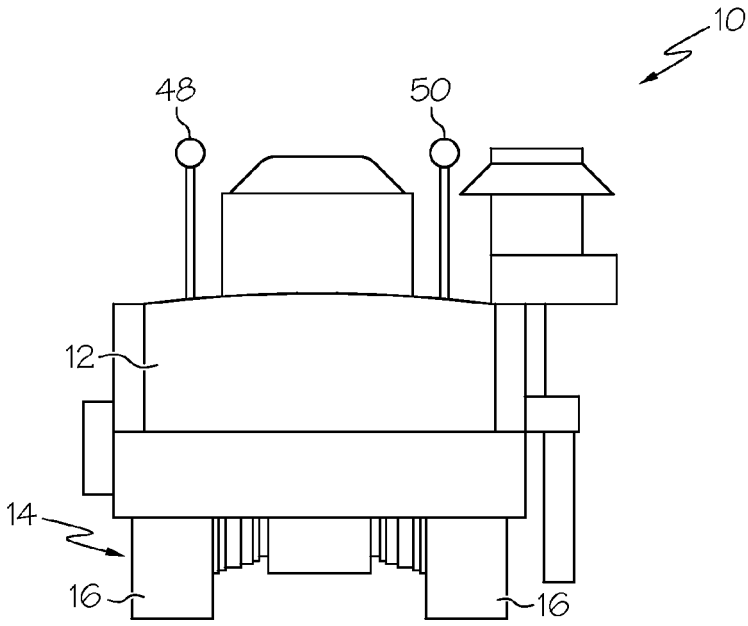
FIG. 2 is a rear view of the electric cable shovel of FIG. 1.

FIGS. 1 and 2 are side and rear views, respectively, of an electric cable shovel 10 incorporating an embodiment of the monitor system. The shovel 10 includes a shovel body 12 that is mounted for rotation on a base 14. The base 14 includes a pair of treads 16 that powered by a (not shown) so that the shovel 10 may be driven around a work site of a mine. The motor may be a diesel engine, electric motors or an electric motor receiving power from a motor-generator set carried on the shovel. The shovel 10 is controlled by an operator in cab 18. A boom 20 (omitted from FIG. 2 for purposes of clarity) extends upward from the shovel body 12 and is connected at its lower end to the body 12. In the illustrated shovel construction the boom 20 is maintained in a fixed position with respect to the body 12, but may also have an angle sensor to further improve the positional accuracy of the computed bucket position. Some shovels, however, have booms which can be raised and lowered with respect to the shovel body. A pulley 22 is mounted on the upper end of the boom 20. A dipper bucket 24 is suspended from the boom 20 by a dipper cable 26 that extends over the pulley 22. A winch 28 (FIG. 4) is mounted on the shovel body 12 and secured to the dipper cable 26. The winch 28 includes a winch drum 30 and an electric motor 32 for winding and unwinding the dipper cable 26 on the winch drum 30. As is apparent, this will raise and lower the dipper bucket 24. A dipper arm 34 is secured to the dipper bucket 24 and supported by an arm mechanism 36 for moving the arm 34 toward and away from the body 12 of the shovel 10. Arm mechanism 36 includes a saddle arrangement 38 and a motor 40 (FIG. 4) for moving the dipper arm 34 toward the body 12 and away from the body 12 of the shovel 10. A rotation sensor is used to count rotations of the motor 40 or pinion to allow the extension of the dipper arm 34 in the saddle arrangement 38, thus giving a computable position of the bucket. Note that the rotation sensor may incorporate a gear reduction to match the rotation sensor range with the required dipper extension range.

Figure 3:
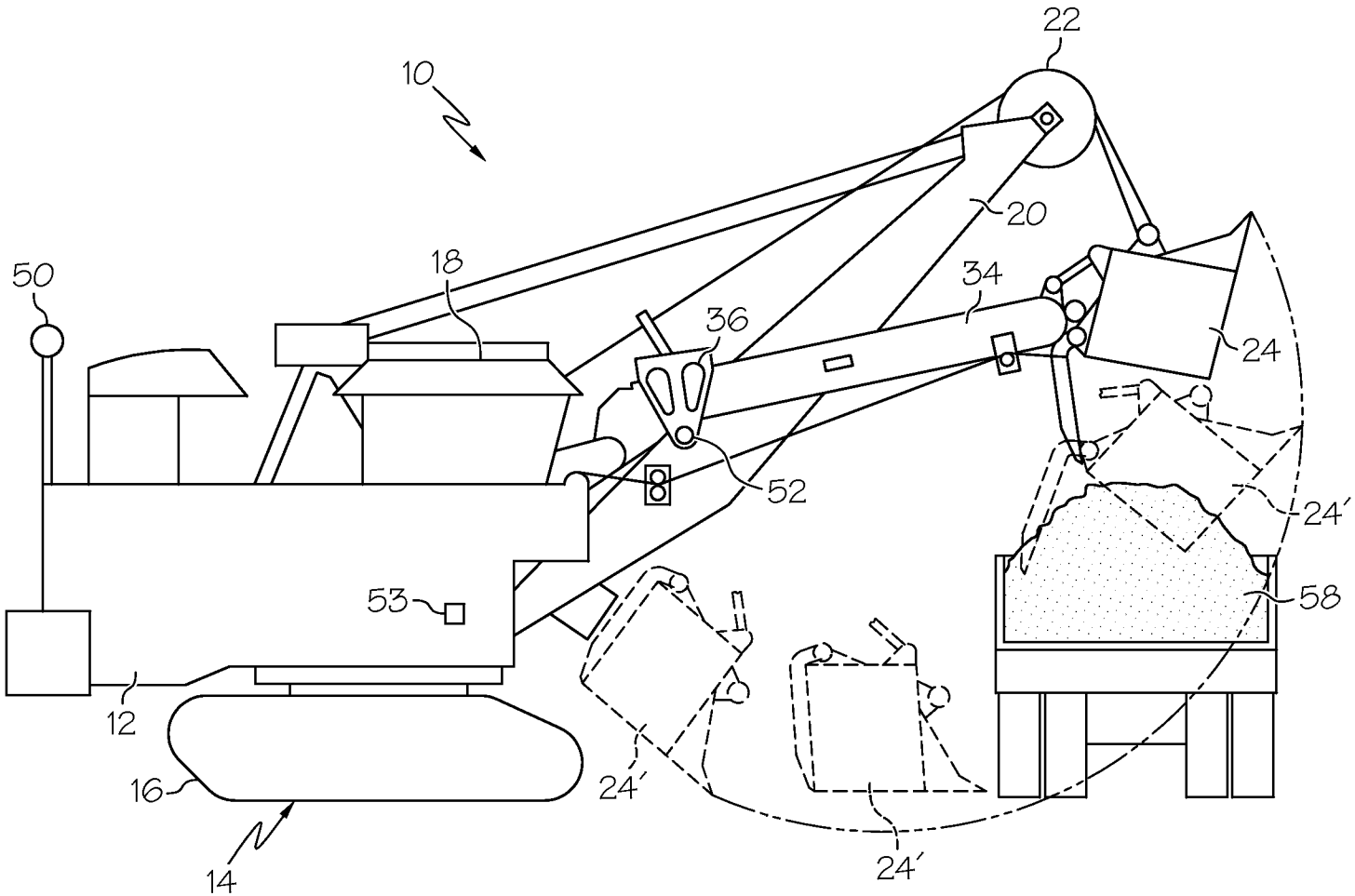
FIG. 3 is a diagrammatic side view, illustrating the movement of the shovel bucket through a digging cycle and the discharge of material from the bucket into a truck for transport.
Figure 4:
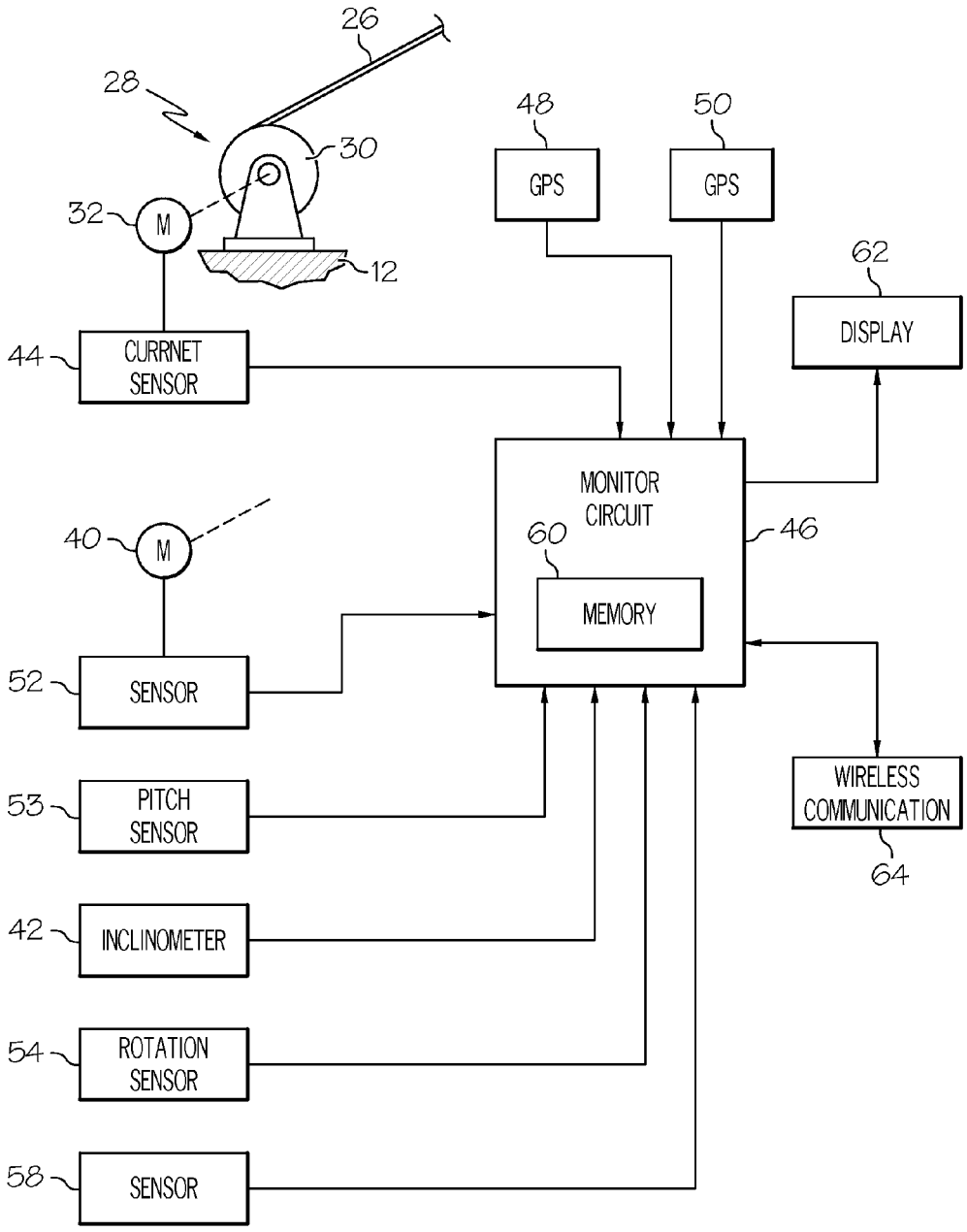
FIG. 4 is a diagrammatic representation of the monitor system.

The monitor system includes an inclinometer 42 that is mounted on the dipper arm 34. The inclinometer 42 provides an output indicative of the inclination of the dipper arm 34. As seen in FIG. 4, the monitor system also includes a current sensor 44 that senses the level of the electrical current supplied to the electric motor 32. A monitor circuit 46, which may take the form of a computer processor, is responsive to the inclinometer 42 and the current sensor 44. The monitor circuit determines when the electric cable shovel has completed a digging operation, based on its inputs. More specifically the monitor circuit 46 determines when the current sensor 44 provides an indication of a current level in excess of a predetermined digging current threshold level for a period of time in excess of a predetermined period, and during such period of time the inclinometer indicates that the inclination of the dipper arm is below a digging threshold inclination. These two conditions, a sufficiently high, sustained level of current and a dipper arm that is lowered sufficiently during that time, are sufficient for the monitor system to conclude that a digging operation has been performed. The predetermined digging current threshold level may be set at a current level that is less than the maximum current drawn by the motor during a normal digging cycle, and greater than the current drawn by the motor if the shovel were cycled through the digging motion without actually filling the bucket with material. As an example, the predetermined digging current threshold level may be set at the average of these two current levels. The predetermined period will be set at the minimum length of time required for the shovel to accomplish one digging movement of the bucket 24. An example of the normal digging movement of the bucket 24 is shown generally in dashed lines 24' in FIG. 3. The inclination of the dipper arm selected as a digging inclination may be between vertical (that is, with the dipper arm hang straight down) and 20 degrees (that is, with the dipper arm 20 degrees below horizontal). Thus, the monitor circuit 46 provides an output indicating that the shovel 10 has completed a digging operation when the motor 32 draws sufficient current, for a set period of time, with the dipper arm 34 positioned in an orientation so that digging is possible (e.g., between vertical and 20 degrees).

The monitor system further includes a pair of GPS receivers 48 and 50, or a single GPS and a heading sensor, that are mounted on the shovel body 12, and a sensor 52 in the arm mechanism 36 for sensing the extension of the dipper arm 34 with respect to the boom 20. The monitor circuit 46 is responsive to the GPS receivers and to the sensor 52 in the arm mechanism, for determining the location and orientation of the electric cable shovel body 12, and, based on this, the location of the bucket 24 during the digging operation. Since the position and orientation of the shovel body 12 at the worksite are known from the GPS receivers (or a single GPS receiver and heading sensor) and from a body pitch sensor 53, and the relative position of the bucket 24 with respect to the body 12 is known from the orientation and extension of the arm 34, body pitch, and boom angle, the precise location of the digging operation is also known.

The electric cable shovel 10 further includes a rotation sensor 54. The sensor 54 senses the rotation of the body 12 of the electric cable shovel 10 on the base 14 of the shovel. Alternatively, the rotation of the machine body may be determined from the outputs of the GPS receivers, or from a heading sensor. A dipper bucket trip lever 56 is provided in the operator cab 18 to allow the operator to open the dipper bucket 24, as illustrated in FIG. 1, to dump the load of material in the bucket 24 accumulated during the previous digging operation. FIG. 3 shows a truck 58 in position to receive a load of material from the bucket 24. Typically, one or more trucks will be positioned to either side of the shovel 10 during digging operations at a mine worksite. After the shovel goes through a digging cycle and therefore carries a quantity of material in the bucket 24, the body of the shovel will rotate toward a truck. The bucket will be positioned over the truck, the lever 56 actuated, and the material deposited in the truck. The shovel will be rotated back into digging position and this operation will be repeated until the truck is full. At this point an empty truck will move into position to receive the material being dug by the shovel. A dipper bucket trip lever sensor 58 senses the actuation of the trip lever 56 by the shovel operator, and provides an indication of actuation to the monitor circuit. The monitor circuit 46 is responsive to the rotation sensor 54 and the trip lever sensor 58 for determining when a load of material in the dipper bucket 24 has been dumped following rotation of the body 12 through a minimum rotation angle. The minimum rotation angle may, for example, be set at 45 degrees. A dumping operation must be registered after a digging operation before a second digging operation can be acknowledged by the system.

It will be appreciated that the monitor system monitors the digging of each bucket of material from a specific location at the mine worksite, and the dumping of each bucket of material into a truck for removal from the mine. The monitor system includes a memory 60 in which a site model is stored. The site model is defined by data that specifying the location and grade of ore throughout the worksite. The location information includes data in three dimensions. Typically, the site model will have been developed by surveying the worksite through any of a number of conventional survey techniques, and by taking ore samples at spaced locations throughout the worksite. The ore samples are analyzed as to the type of ore and its quality, and this data is combined with the contour information to complete the site model. The monitor system therefore keeps track of the position of the ore deposits that are mined, and also the recontouring of the mine surface.

If desired, the monitor system may provide information to the operator of the electric cable shovel when areas of the worksite being mined have ore quality that is not sufficiently high to be processed. The monitor system will refer to the site model in memory 60 as each bucket of material is dug from the site. The monitor system determines whether the ore in the bucket is to be processed or is to be discarded, and this information is then displayed on display 62 for the shovel operator. Several trucks may be positioned adjacent the shovel, with one of the trucks reserved for material that is to be removed and discarded. The operator will then act on the displayed information, and the material will be dumped in the appropriate truck. It will be appreciated that the site model topology may be updated by the system as the shovel is operated, removing material from the worksite and changing the contour of the worksite. If multiple shovels are in operation, it will be appreciated that their monitors systems may communicate wirelessly via wireless communication circuit 64 to maintain an updated site model that reflects excavation work done by all of the shovels at the worksite.

What is claimed is:

1. A monitor system for an electric cable shovel, said electric cable shovel having a shovel body mounted for rotation on a base, a boom extending upward from said shovel body and connected at its lower end to said body, a pulley mounted on the upper end of the boom, a dipper bucket suspended from the boom by a dipper cable extending over the pulley, a winch mounted on the shovel body and secured to the dipper cable, said winch including a winch drum and an electric motor for winding and unwinding said dipper cable on said winch drum so as to raise and lower said dipper bucket, a dipper arm secured to said dipper bucket and supported by an arm mechanism for moving said arm toward and away from said body of the shovel, comprising:

an inclinometer mounted on said dipper arm for providing an output indicative of the inclination of said dipper arm, a current sensor for sensing the level of the electrical current supplied to said electric motor, and a monitor circuit for determining when the current sensor provides an indication of a current level in excess of a digging current threshold level for a period of time in excess of a predetermined period, and during such period of time said inclinometer indicates that said inclination of said dipper arm is below a digging threshold inclination, said monitor providing an output indicating that said shovel has completed a digging operation, filling the dipper bucket with material.

2. The monitor system for an electric cable shovel of claim 1, in which said monitor system further includes a pair of GPS receivers mounted on said shovel body and a sensor in said arm mechanism for determining the extension of said arm with respect to said boom, and said monitor circuit is responsive to said GPS receivers and to said sensor in said arm mechanism, for determining the location and orientation of the electric cable shovel body, and for determining the location of said digging operation.

3. The monitor system for an electric cable shovel of claim 2, in which said electric cable shovel further includes a rotation sensor for sensing rotation of the body of the electric cable shovel on the base of the shovel, and a dipper bucket trip lever sensor for sensing actuation of said trip lever by an operator, and in which said monitor circuit is responsive to said rotation sensor and said trip lever sensor for determining when a load of material in said dipper bucket has been dumped following rotation of said body through a minimum rotation angle.

4. The monitor system for an electric cable shovel of claim 3, in which said monitor system further includes a memory having stored therein a site model having data specifying the location and grade of ore at the worksite, and in which said monitor system compares each dig operation to said site model to determine the ore in the material in said dipper bucket so that the dipper bucket may be dumped in an appropriate transport truck.

5. The monitor system for an electric cable shovel of claim 1, in which said monitor system further includes a GPS receiver and a heading sensor mounted on said shovel body, and a sensor in said arm mechanism for determining the extension of said arm with respect to said boom, said monitor circuit being responsive to said GPS receiver, to said heading sensor, and to said sensor in said arm mechanism, for determining the location and orientation of the electric cable shovel body, and for determining the location of said digging operation.

6. The monitor system for an electric cable shovel of claim 5, in which said electric cable shovel further includes a dipper bucket trip lever sensor for sensing actuation of said trip lever by an operator, and in which said monitor circuit is responsive to rotation as sensed by said GPS receiver and said heading sensor, and to said trip lever sensor for determining when a load of material in said dipper bucket has been dumped following rotation of said body through a minimum rotation angle.

7. The monitor system for an electric cable shovel of claim 6, in which said monitor system further includes a memory having stored therein a site model having data specifying the elevation, location and grade of ore at the worksite, and in which said monitor system compares each dig operation to said site model to determine the ore in the material in said dipper bucket so that the dipper bucket may be dumped in an appropriate transport truck.

8. A method of monitoring the operation of an electric cable shovel, said electric cable shovel having a shovel body mounted for rotation on a base, a boom extending upward from said shovel body and connected at its lower end to said body, a pulley mounted on the upper end of the boom, a dipper bucket suspended from the boom by a dipper cable extending over the pulley, a winch mounted on the shovel body and secured to the dipper cable, said winch including a winch drum and an electric motor for winding and unwinding said dipper cable on said winch drum so as to raise and lower said dipper bucket, a dipper arm secured to said dipper bucket and supported by an arm mechanism for moving said arm toward and away from said body of the shovel, comprising the steps of:

determining the inclination of said dipper arm, sensing the level of the electrical current supplied to said electric motor, determining when the current level exceeds a digging current threshold level for a period of time in excess of a predetermined period, and during such period of time said dipper arm is below a digging threshold inclination, and providing an output indicating that said shovel has completed a digging operation.

9. The method of monitoring the operation of an electric cable shovel according to claim 8, in which said monitor system further includes a pair of GPS receivers mounted on said shovel body and in which the method further includes the steps of:

determining the extension of said arm with respect to said boom, determining the pitch angle of the body, determining the location and orientation of the electric cable shovel body, and determining the location of said digging operation.

10. The method of monitoring the operation of an electric cable shovel according to claim 9, in which said electric cable shovel further includes a rotation sensor for sensing rotation of the body of the electric cable shovel on the base of the shovel, and a dipper bucket trip lever sensor for sensing actuation of said trip lever by an operator, and in which the method further includes the step of determining when a load of material in said dipper bucket has been dumped following rotation of said body through a minimum rotation angle.

11. The method of monitoring the operation of an electric cable shovel according to claim 10, in which said monitor system further includes a memory having stored therein a site model having data specifying the location and grade of ore at the worksite, and in which the method further includes the steps of comparing each detected dig operation to said site model to determine the ore in the material in said dipper bucket resulting from the dig operation so that the dipper bucket may be dumped in an appropriate transport truck.

12. The method of monitoring the operation of an electric cable shovel according to claim 8, in which said monitor system further includes a GPS receiver and heading sensor mounted on said shovel body and in which the method further includes the steps of:

determining the extension of said arm with respect to said boom, determining the location and orientation of the electric cable shovel body from the outputs of the GPS receiver and heading sensor, and determining the location of said digging operation.

13. The method of monitoring the operation of an electric cable shovel according to claim 12, in which rotation of said electric cable shovel is determined from the outputs from said GPS receiver and heading sensor, in which said electric cable shovel further includes a dipper bucket trip lever sensor for sensing actuation of said trip lever by an operator, and in which the method further includes the step of determining when a load of material in said dipper bucket has been dumped following rotation of said body through a minimum rotation angle.

14. The method of monitoring the operation of an electric cable shovel according to claim 8, in which said monitor system further includes a pair of GPS receivers mounted on said shovel body and a dipper bucket trip lever sensor for sensing actuation of said trip lever by an operator, and in which the method further includes the steps of:

determining the extension of said arm with respect to said boom, determining the location and orientation of the electric cable shovel body from the outputs of the GPS receivers, determining the location of said digging operation from the outputs of the GPS receivers, determining the rotation of the shovel from the outputs of the GPS receivers, and determining when a load of material in said dipper bucket has been dumped following rotation of said body through a minimum rotation angle.

* * * * *